United States Patent [19]

Allart et al.

[11] 4,157,056

[45] Jun. 5, 1979

[54] MULTI-CYLINDER HYDRAULIC MECHANISM

[75] Inventors: Bernard R. Allart, Crepy en Valois; Patrick E. Ramousse, La Croix Saint Ouen, both of France

[73] Assignee: Poclain Hydraulics, Verberie, France

[21] Appl. No.: 835,404

[22] Filed: Sep. 20, 1977

[30] Foreign Application Priority Data

Sep. 21, 1976 [FR] France ..... 76 28323

[51] Int. Cl.[2] ..... F01B 13/06

[52] U.S. Cl. ..... 91/491

[58] Field of Search ..... 91/491, 492, 498

[56] References Cited

U.S. PATENT DOCUMENTS

| | | | |
|---|---|---|---|
| 3,296,937 | 1/1967 | Guinot | 91/498 |
| 3,369,457 | 2/1968 | Guinot | 91/491 |
| 3,593,621 | 7/1971 | Praddaude | 91/492 |
| 3,808,951 | 5/1974 | Martin | 91/492 |

*Primary Examiner*—William L. Freeh

*Attorney, Agent, or Firm*—Mason, Fenwick & Lawrence

[57] ABSTRACT

A hydraulic mechanism, e.g. a pump or motor, comprises a plurality of cylinders and pistons and a piston-displacement selector which is provided with blind helical grooves for controlling connection of the cylinders to the main fluid supply.

8 Claims, 10 Drawing Figures

FIG. 3
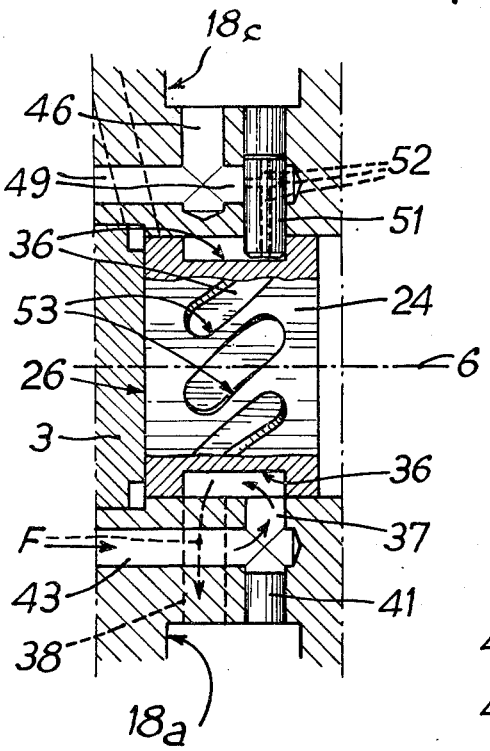
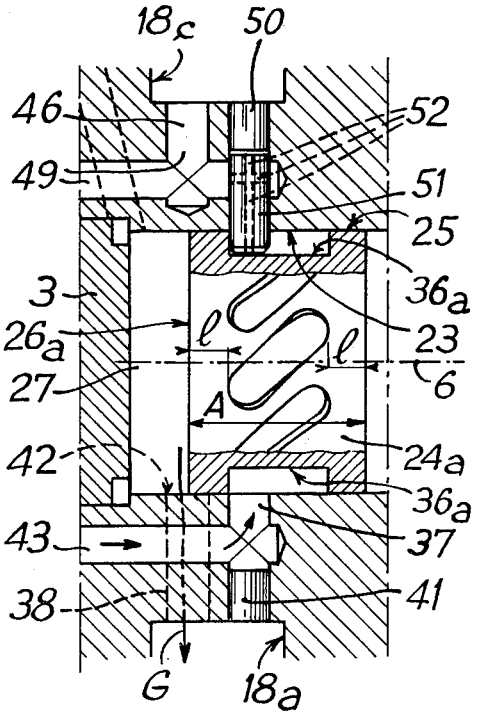
FIG. 4

MULTI-CYLINDER HYDRAULIC MECHANISM

The present invention relates to improvements in multi-cylinder hydraulic mechanisms.

Some known hydraulic pumps and engines comprise cylinders in which the pistons are slidably mounted and also have a piston-displacement selector which disconnects or connects one or more groups of the cylinders to the main circuit supplying fluid to the mechanism.

Known selectors operate by means of grooves, frequently circular grooves, which are moved opposite ducts formed in the cylinders to be disconnected, or which are disconnected from the ducts. The various grooves are disposed in succession, with the result that the selector is wide and thus is inconveniently bulky and heavy.

Furthermore, sealing-tightness must be ensured along the edges of substantial lengths of grooves, which raises important technological problems, many of which have not been properly solved, with the result that quite considerable leakages of pressure fluid occur. Furthermore, the sealing-tight surfaces are increased in order to increase the sealing-tightness, which further increases the weight and bulk.

According to the invention there is provided a hydraulic mechanism, e.g. a motor or pump, comprising:

a cylinder block;

a cam;

means for rotatably mounting said cam with respect to said cylinder block;

a plurality of cylinders disposed in said cylinder block;

a piston slidable in each cylinder and bearing on said cam;

a cylinder fluid distributor comprising a chamber for containing cylinder supply fluid and a chamber for containing fluid derived from said cylinders, said chambers being connectable to said cylinders via ducts formed in said cylinder block and opening into a distribution surface of said distributor;

means comprising said cylinder fluid distributor to said cam; and a piston-displacement selector disposed on said ducts of at least some of said cylinders coaxially with respect to the axis of rotation of said cam relative to said cylinder block, said selector being bounded by a cylindrical surface in contact with a bore in said cylinder block into which said ducts open, said selector being movable in a straight line between first and second positions and being formed with grooves extending parallel to the direction of said movement, said grooves being blind and opening only into said cylindrical surface of said selector;

said cylinders being divided into at least a first group and a second group, the cylinders of said first group being adapted to be permanently disconnected from at least one of said two chambers by said piston-displacement selector wherein said ducts of one of said cylinders in said first group of cylinders comprise the following three distinct portions;

a first portion which opens into the cylinder-block bore and is permanently connected to one of said grooves and to a third duct portion permanently disconnected from said cylinder, said first duct portion extending substantially parallel to said cylinder axis and being contained in a plane substantially parallel to a radial plane, a second portion which permanently connects said cylinder to said bore and is substantially parallel to the axis of said cylinder and is contained in a plane substantially parallel to the radial plane and distinct from the last mentioned plane, which contains the first portion, and a third portion which permanently connects said first portion to said distribution surface of said distributor such that when said selector is in said first position, said second portion opens into one of said grooves and, when said selector is in said second position, said second portion is disconnected from said last mentioned groove; and wherein said grooves are helical and have a pitch equal to the pitch of motion (likewise helical) of said selector which is similarly helical, and said third portion is substantially parallel to the axis of rotation and opens into said first portion without interfering with said second portion.

Advantageously said selector is coupled to a jack for adjusting its position, said jack comprising a working chamber selectively connected to a source of control fluid and to a discharge reservoir. When the working chamber is connected to the source, said selector is moved to its second position to partly uncover the orifice through which said second duct portion opens to said bore to connect said orifice to said working chamber.

Preferably the cylinders of said second group of cylinders are each permanently connected to said distribution surface by a duct comprising a fourth portion substantially parallel to the axis of the corresponding cylinder and permanently connecting said cylinder to said bore while permanently opening into one of said grooves, and a fifth portion parallel to the axis of rotation and permanently connecting said fourth portion to said distribution surface.

Advantageously said fourth portion has a position, relative to the corresponding cylinder, which is identical with the position of said first portion with respect to its said cylinder.

The mechanism may include a third group of cylinders comprising at least one cylinder permanently connected to said distribution surface by a duct comprising a sixth portion substantially parallel to the axis of the corresponding cylinder and opening into said cylinder, a seventh portion parallel to the axis of rotation and permanently connecting said sixth portion to said distribution surface, and an eighth portion substantially parallel to the cylinder axis and permanently disposed in alignment with one of said grooves and receiving a stud which guides the motion of the selector and is engaged in said grooves. An eighth portion permanently communicates with said seventh portion, internal ducts formed in the stud permanently connecting said groove to said seventh portion.

The sixth and eighth portions may be contained in a single plane parallel to a radial plane, and the eighth portion may have a position, relative to the corresponding cylinder, which is identical with the position of said first portion relative to its cylinder.

The invention will be more fully understood from the following description of an embodiment thereof given by way of example only, with reference to the accompanying drawings:

In the accompanying drawings,

FIG. 3 is a section along the line III—III in FIG. 2 showing the piston-displacement selector of the mechanism of FIGS. 1 and 2 in a first position;

Figure 1:
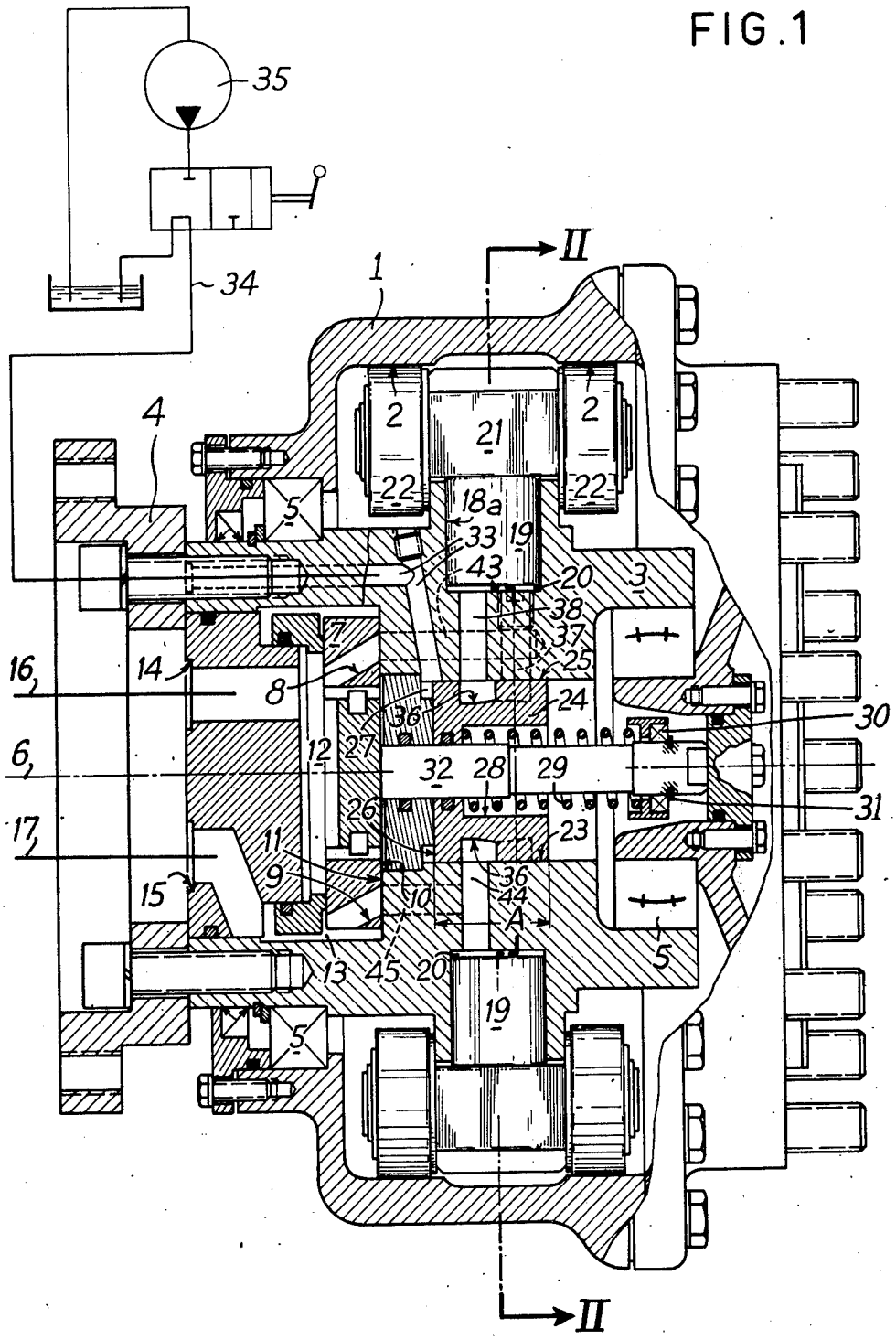
FIG. 1 is an axial section through an embodiment of a mechanism according to the invention.
Figure 2:
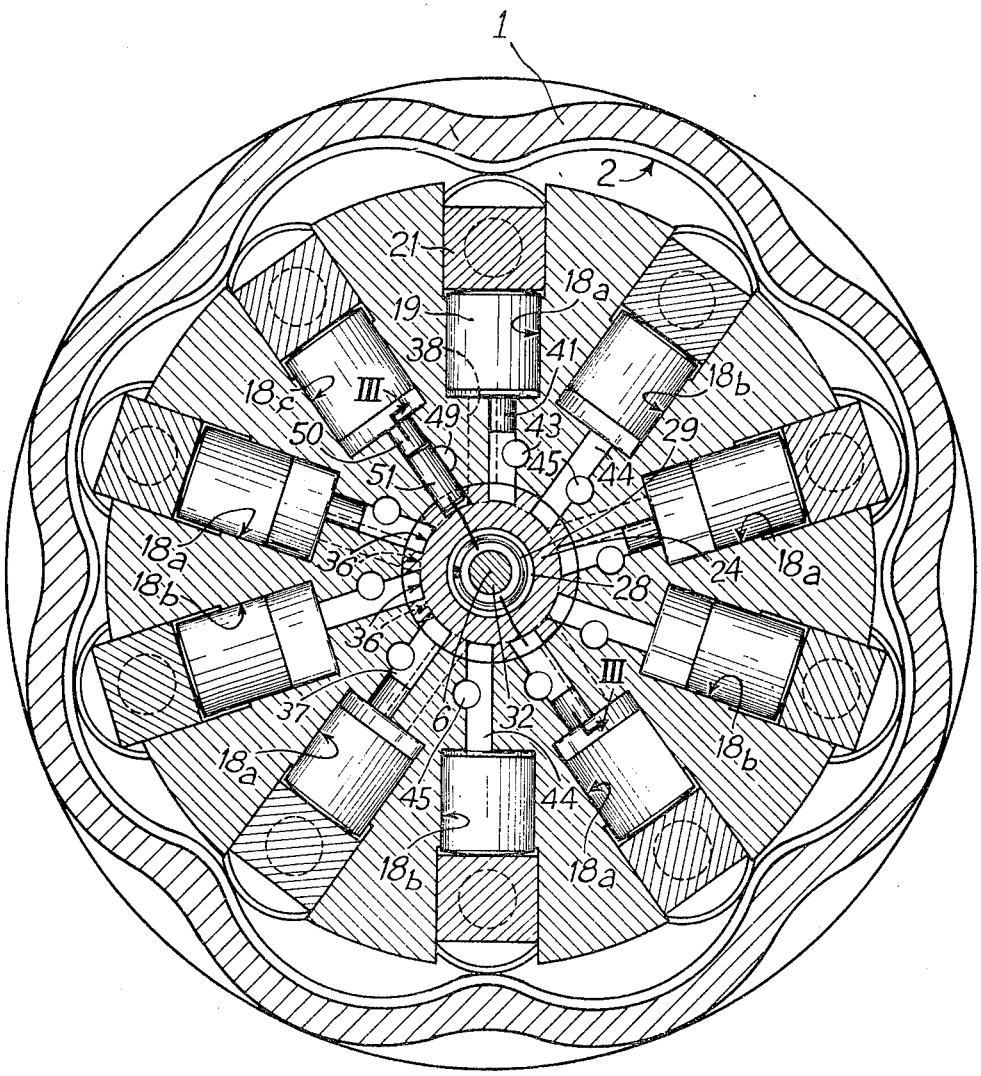
FIG. 2 is a section along the line II—II in FIG. 1.
Figure 5A:
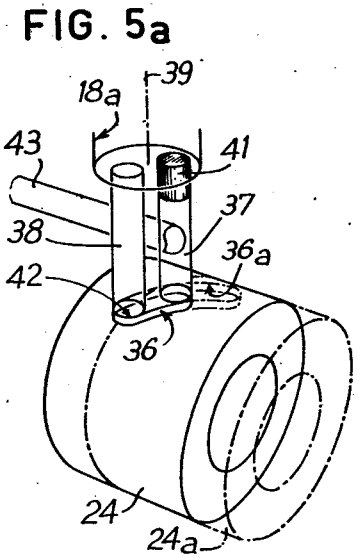
Figure 5B:
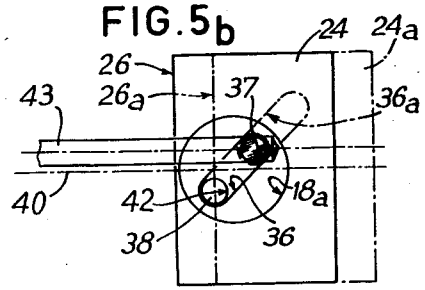

FIG. 4 in section along the line III—III of FIG. 2 shows the piston-displacement selector of the mechanism of FIGS. 1 and 2 in its second position;

FIG. 5*a* is a perspective view of the ducts supplying a cylinder of the first group of cylinders;

FIG. 5*b* is a diagrammatic plan view of the ducts of FIG. 5*a;*

Figure 6A:
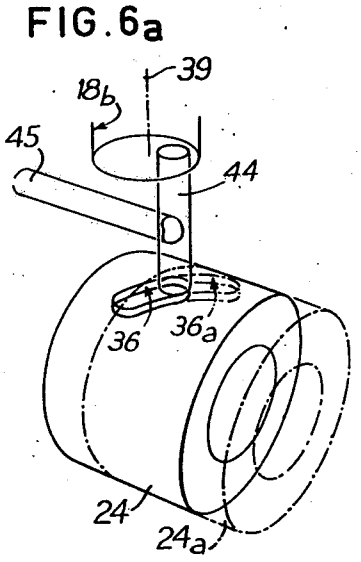
Figure 6B:
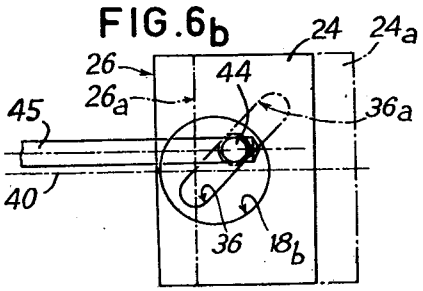

FIG. 6*a* is a perspective view of the supply ducts of a cylinder of the second group of cylinders;

FIG. 6*b* is a diagrammatic plan view of the ducts of FIG. 6*a;*

Figure 7A:
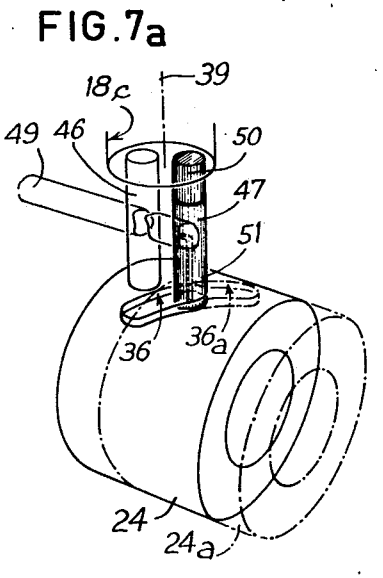
Figure 7B:
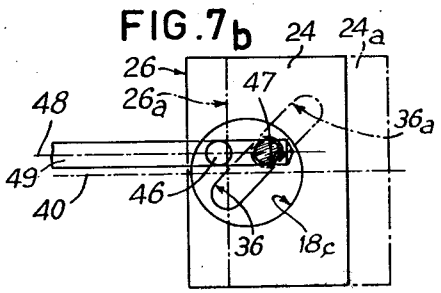

FIG. 7*a* is a perspective view of the ducts supplying a cylinder of the third group of cylinders; and FIG. 7*b* is a diagrammatic plan view of the ducts of FIG. 7*a.*

FIGS. 1 and 2 show an engine comprising a casing 1, two cams 2 secured to the casing, a cylinder block 3 disposed inside casing 1, a flange 4 for securing the cylinder block to a stationary structure such as the frame of a hydraulic shovel, and roller bearings 5 disposed between casing 1 and cylinder block 3 and permitting rotation of casing 1 and cams 2 round an axis 6 with respect to the cylinder block. The engine is called a "rotating-cam" engine since the casing is secured to the cams and rotates, but of course the invention is not intended to be limited t this single embodiment.

A distribution member 7 comprises two sets of orifices 8, 9 opening into a flat distribution surface 10 of member 7, which rotates with casing 1. Surface 10 bears on a flat surface 11 of cylinder block 3. Orifices 8, 9 open into two chambers 12, 13 which in turn communicate with two connections 14, 15 secured to casing 1 for attachment to ducts 16, 17 conveying high-pressure and low-pressure fluid respectively.

Cylinder block 3 contains cylinders 18*a,* 18*b,* 18*c* inside which pistons 19 are slidably mounted. Inside the cylinders, the pistons bound chambers 20 and bear against beams 21 provided with runners 22 which bear on cams 2.

Cylinder block 3 has a cylindrical bore 23 coaxial with the axis of rotation 6. A piston-displacement selector 24 has a cylindrical surface 25 in sealing-tight contact with bore 23. Selector 24 is bounded by a transverse surface 26 which cooperates with the cylinder block to form a "control" chamber 27.

A return spring 29 is disposed in a recess 28 of selector 24 remote from surface 26 and bears on a ball abutment 30 which axially bears on a washer 31 secured to a shaft 32. The return spring 29 holds the selector 24 in its first position and opposes the action of a control fluid which may be contained in chamber 27. Chamber 27 is connected to a source 35 of control fluid by ducts 33 formed in cylinder block 3 and by an external connecting duct 34 connected to duct 33.

The connection between cylinder chambers 20 and the distribution surface 10 will now be described.

The ten radially-disposed cylinders are in fact divided into three groups of cylinders 18*a,* 18*b* and 18*c.* Cylinders 18*a* and 18*b* alternate with one another except for one of the cylinders 18*b,* which is replaced by a single cylinder 18*c* disposed between two cylinders 18*a.*

Selector 24 has ten blind grooves 36 which open into its cylindrical surface 25, have a helical shape and have a pitch equal to the movement pitch of selector 24. Only one of these grooves has been shown in FIGS. 5*a,* 5*b,* FIG. 6*a,* 6*b,* 7*a* and 7*b,* in order to simplify the drawings, which are given only to explain the operation of the selector. In the aforementioned drawings, the selector is shown in continuous lines in its first position 24, the groove being denoted by 36 and the transverse surface of the distributor being disposed at 26. The selector is shown in broken lines in its second position 24*a,* which corresponds to position 36*a* of the groove and position 26*a* of the groove in the transverse surface.

A cylinder 18*a* is connected to bore 23 by two duct portions 37, 38 substantially parallel to the cylinder axis 39 and disposed on either side of a plane 40 extending through the axis of rotation 6. Portion 37 permanently opens opposite the groove, whether the groove is in position 36 or 36*a,* but has a plug 41 which disconnects it from cylinder 18*a*. Portion 38 communicates with the groove when the latter is in its first position 36, but is disconnected in position 36*a*. When the selector is in position 24*a,* orifice 42 communicates with the control chamber 27. Finally a third duct portion 43 parallel to the axis of rotation 6 connects duct portion 37 to the flat surface 11 of cylinder block 3, i.e. to the distribution surface 10, and is successively placed in communication with orifices 8 and 9 when cams 2 rotate with respect to cylinder block 3.

Cylinder 18*b* is connected to bore 23 by a fourth duct portion 44 which is parallel to the cylinder axis 39 and permanently opens into groove 36 or 36*a* and is in a position identical with that of the first duct portion with respect to cylinder 18*a*. A fifth duct portion 45 parallel to axis 6 connects the fourth portion 44 to the flat surface 11 of a cylinder block and is successively connected to orifices 8 and 9 during the rotation of cams 2 relative to cylinder block 3.

A sixth duct portion 46 substantially parallel to axis 39 of cylinder 18*c* is permanently connected to cylinder 18*c* and to a seventh duct portion 49, which is parallel to axis 6, is connected to the flat surface 11 and successively communicates with orifices 8 and 9 during the rotation of cams 2 relative to cylinder block 3. An eighth duct portion 47, substantially parallel to axis 39, connects cylinder 18*c* to bore 23, communicates with the seventh duct portion 49, is disconnected from cylinder 18*c* by a plug 50 and contains a stud 51 which is permanently inserted into a groove 36 or 36*a*. In addition, the sixth and eighth duct portions 46 and 47 are substantially in a single plane 48 parallel to a radial plane. Stud 51 also has internal ducts 52 which permanently connect grooves 36 or 36*a* to the seventh duct 49. Plug 50 is used only for holding stud 51 in position, not for blocking portion 47.

The operation of the device will now be described, when the piston-displacement selector is in the first position and the second position.

When the selector is in the first position 24, each duct portion 43, 45, 49 successively communicates with orifices 8 and 9.

Cylinder 18*a* communicates with portion 43 via portion 37, groove 36, and portion 38 (arrows F). Cylinder 18*b* communicates with portion 45 via portion 44. Cylinder 18*c* communicates with portion 49 via portion 46. In short, all the cylinders are successively connected to the high-pressure aperture 8 and the low-pressure aperture 9. The piston displacement of the engine is equal to the sum of the displacements of all the cylinders.

When the control fluid source 35 is properly connected to the control chamber 27, the control fluid pushes the selector surface 26 and places the distributor in position 24*a*. Cylinders 18*b* and 18*c* continue to be supplied as previously described. Cylinders 18*a* on the other hand, are no longer connected to portions 43, since portions 38 are now disconnected from groove 36*a*. Consequently the total piston displacement of the engine is equal only to the sum of the displacements of cylinders 18*b* and 18*c*. The total piston displacement of the engine has been changed, mainly by means of portions 37, 38 and the corresponding grooves 36.

Of course, those grooves 36 which communicate with duct portion 44 do not play any part in changing the piston displacement. However, they contain a fluid at a pressure equal to that of the fluid in portions 45. Consequently, they provide fluid operating surfaces which are equal to and diametrically opposed to those of the grooves which communicate with portions 37. Consequently, they balance the radial forces acting on selector 24.

The same balancing effect is provided by groove 36, into which stud 51 is introduced, since the internal ducts 52 connect groove 36 with portion 49.

Stud 51, of course, guides selector 24 during its helical motion and brings it into position 24*a*. The motion occurs at a pitch which is clearly identical with that of groove 36 into which stud 51 is introduced, or the pitch of any other groove 36. Stud 51 also limits the motion of selector 24.

Since the various grooves are all within two transverse planes separated by a relatively short distance, the width A of the selector is itself small compared with the width of the known grooves selectors. Consequently, the above described selector can be compact and light, as can the engine in which it is used.

Furthermore, the length of the edge 53 of each groove 36 is small compared with that of a circular groove round the axis 6. This reduces the risk of hydraulic fluid escaping between bore 23 and cylindrical surface 25. Consequently the distance 6 between the transverse surfaces of selector 24 and those parts of the grooves which are nearest the transverse surfaces can be small, thus further reducing the bulk and weight of the engine.

When cylinders 18*a* are disconnected from the respective portions 43 (when the selector is in position 24*a*), the cylinders continue to be supplied with low-pressure or medium-pressure fluid, which fills them. The fluid is the control fluid which is in the control chamber 27 and flows into portion 38 via orifices 42 (arrow G) since selector 24*a* has uncovered orifices 42.

Grooves 36, whether helical or not, must be parallel to the direction of motion of selector 24. When the grooves are helical, portions 37 can easily be connected to the corresponding portions 43 simply by boring the cylinder blocks 3, without ducts 43 interfering with portions 38.

If the grooves were straight, e.g. parallel to the axis of rotation 6, complicated drilling would be necessary for connecting portions 37 and 43 without interfering with portions 38. However, straight grooves, though apparently less advantageous then helical grooves, can be used.

The invention is not intended to be limited to the embodiment described above but covers all variants within the scope of the appendant claims.

What is claimed is:

1. A hydraulic mechanism, e.g. a motor or pump, comprising:

a cylinder block;

a cam;

means rotatably mounting said cam with respect to said cylinder block;

a plurality of cylinders disposed in said cylinder block;

a piston slidable in each cylinder and bearing on said cam;

a cylinder fluid distributor connected to said cam including a high pressure chamber for containing cylinder supply fluid and a low pressure chamber for containing fluid delivered from said cylinders, said chambers being connectable to said cylinders via ducts formed in said cylinder block and opening into a distribution surface of said distributor;

a piston-displacement selector disposed for movement coaxially with respect to the axis of rotation of said cam relative to said cylinder block, said selector being bounded by a cylindrical surface in contact with a cylinder block bore in said cylinder block into which said ducts open, said selector being movable axially in a straight line between first and second positions, and including blind grooves extending radially into said cylindrical surface of said selector;

said cylinders being divided into at least a first group and a second group, the cylinders of said first group being adapted to be blocked from communication with one of said two chambers by said piston-displacement selector when said selector is in its second position wherein said ducts of one of said cylinders in said first group of cylinders comprise the following three distinct portions:

a first duct portion which opens into the cylinder block bore on one end and which communicates with one of said grooves when said selector is in either said first or said second position, said first duct portion extending substantially parallel to said cylinder axis and being contained in a plane substantially parallel to a radial plane, a second duct portion which has one end communicating with said cylinder and an opposite end which communicates with said cylinder block bore and with one of said grooves only when said selector is in its first position, said second duct portion being substantially parallel to the axis of said cylinder and contained in a plane substantially parallel to the radial plane distinct from the last mentioned radial plane, which contains the first duct portion, and a third duct portion which connects said first duct portion to said to said fluid distributor; and wherein said grooves are helical and have a pitch equal to the pitch of motion (likewise helical) of said selector which is similarly helical, and said third duct portion is substantially parallel to the axis of rotation and opens into said first portion without interfering with said second portion.

2. A mechanism according to claim 1, wherein said selector is coupled to a jack for moving said selector between its positions, said jack comprising a working chamber selectively connected to a source of control fluid and to a discharge reservoir, such that when said working chamber is connected to said source, said selector is placed in its second position and at least part of said cylinder block bore of said cylinder block, into which said second duct portion opens, is exposed to communicate said second duct portion to said working chamber.

3. A mechanism according to claim 1, wherein the cylinders of said second group of cylinders are each connected to said distribution surface by a duct comprising a fourth duct portion oriented substantially parallel to the axis of its corresponding cylinder and connecting said cylinder to said cylinder block bore and to one of said grooves when said selector is in either its first or second position, and a fifth duct portion parallel to said axis of rotation and permanently connecting said fourth duct portion to said distribution surface.

4. A mechanism according to claim 3, characterized in that said fourth duct portion has a position, relative to said corresponding cylinder, which is identical with the position of said first duct portion with respect to its cylinder.

5. A mechanism according to claim 3, including a third group of cylinders comprising at least one cylinder connected to said distribution surface by a duct comprising a sixth duct portion substantially parallel to the axis of its corresponding cylinder and opening into said cylinder, a seventh duct portion parallel to said axis of rotation and connecting said sixth duct portion to said distribution surface, and an eighth duct portion substantially parallel to the cylinder axis and disposed in alignment with one of said grooves and a stud in said eighth duct portion which extends into its associated groove and guides the motion of the selector.

6. A mechanism according to claim 5, wherein said eighth duct portion communicates with said seventh duct portion, and internal ducts are formed in said stud connecting said groove to said seventh duct portion.

7. A mechanism according to claim 5, wherein said sixth and said eighth duct portions are contained in a single plane parallel to a radial plane.

8. A mechanism according to claim 5, wherein said eighth duct portion has a position, relative to said corresponding cylinder, which is identical with the position of said first duct portion relative to its corresponding cylinder.

* * * * *